US006589098B2

(12) United States Patent
Lee et al.

(10) Patent No.: US 6,589,098 B2
(45) Date of Patent: Jul. 8, 2003

(54) TOY VEHICLE WITH PIVOTALLY MOUNTED SIDE WHEELS

(75) Inventors: Jason Lee, Princeton Junction, NJ (US); Mark Sullivan, Manhattan Beach, CA (US); Jonathan A. Jaffe, Voorhees, NJ (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 09/777,578

(22) Filed: Feb. 6, 2001

(65) Prior Publication Data

US 2001/0044255 A1 Nov. 22, 2001

Related U.S. Application Data

(63) Continuation-in-part of application No. PCT/US99/18042, filed on Aug. 6, 1999.

(51) Int. Cl.[7] ..... A63H 17/00

(52) U.S. Cl. ..... 446/465; 446/469; 446/466; 446/470; 446/431

(58) Field of Search ..... 446/469, 466, 446/470, 431; 280/677

(56) References Cited

U.S. PATENT DOCUMENTS

| | | | | |
|---|---|---|---|---|
| 1,333,216 A | | 3/1920 | Pajeau | |
| 1,623,144 A | | 4/1927 | Weiss | |
| 1,828,288 A | | 10/1931 | Marx | |
| 1,868,313 A | | 7/1932 | Daubendiek | |
| 1,871,297 A | | 8/1932 | Berger | |
| 2,064,309 A | | 12/1936 | Lohr | |
| 2,103,381 A | * | 12/1937 | Perkins et al. | 267/291 |
| 2,124,149 A | * | 7/1938 | Redhead | 280/677 |
| 2,246,609 A | | 6/1941 | Townsend | |

(List continued on next page.)

FOREIGN PATENT DOCUMENTS

| | | |
|---|---|---|
| GB | 2 118 851 A | 11/1983 |
| GB | 2 131 309 A | 6/1984 |
| JP | 56-22108 | 3/1981 |

(List continued on next page.)

OTHER PUBLICATIONS

Klarer, P.R.; Report entitled *Lunar Exploration Rover Program Development* NASA Technical Reports Document ID 19940018996 N (94N23469); Space Operations Applications and Research Conference, Houston, TX, Aug. 1993, covers with an eight page report, plus separate abstract page and *General Disclaimer* page.

(List continued on next page.)

*Primary Examiner*—Derris H. Banks
*Assistant Examiner*—Dmitry Suhol
(74) *Attorney, Agent, or Firm*—Akin Gump Strauss Hauer & Feld, L.L.P.

(57) ABSTRACT

A radio-controlled toy vehicle is provided with four non-steerable wheels, two on each lateral side of the vehicle. In one embodiment, the wheels on each lateral side are drivingly coupled with a separate, reversible motor. The vehicle is steered by controlling the operation and direction of each motor. In another embodiment, the wheels on each lateral side are drivingly coupled with a single reversible motor. The vehicle is steered through one-way clutches which allow the wheels on one lateral side to operate in either a forward or a reverse direction while the wheels on an opposite lateral side always rotate in the same direction. In both embodiments, a pivoting beam is centrally located on one lateral side, with the wheels on that side being rotatably attached to the beam. The pivoting beam provides for infinite ranges of suspension positions. In operation, the vehicle proceeds until it encounters an obstacle. Depending upon the size of the obstacle relative to the size of the vehicle wheels, the vehicle either rolls over the obstacle or climbs up the obstacle and flips over. In yet another embodiment, two beams are provided, each supporting a pair of front and rear wheels on separate lateral sides of the vehicle.

19 Claims, 12 Drawing Sheets

U.S. PATENT DOCUMENTS

| | | | | |
|---|---|---|---|---|
| 2,247,354 | A | | 7/1941 | Berger |
| 2,319,978 | A | | 5/1943 | Collender |
| 2,380,174 | A | * | 7/1945 | Haselton ..... 280/677 |
| 2,434,693 | A | * | 1/1948 | Graham ..... 172/811 |
| 2,832,426 | A | | 4/1958 | Seargeant |
| 3,190,384 | A | | 6/1965 | Dufresne |
| 3,263,363 | A | | 8/1966 | Doe |
| 3,348,518 | A | | 10/1967 | Forsyth et al. |
| 3,445,959 | A | | 5/1969 | Barlow et al. |
| 3,540,151 | A | | 11/1970 | Ishida |
| 3,590,526 | A | | 7/1971 | Deyerl et al. |
| 3,646,706 | A | | 3/1972 | Adickes |
| 3,716,250 | A | * | 2/1973 | Gorres ..... 280/677 |
| 3,733,739 | A | | 5/1973 | Terzian |
| 3,785,085 | A | | 1/1974 | Peroni |
| 3,813,812 | A | | 6/1974 | Barlow et al. |
| 3,816,958 | A | | 6/1974 | Winston |
| 3,849,931 | A | | 11/1974 | Gulley, Jr. |
| 3,932,956 | A | | 1/1976 | Young |
| 4,107,872 | A | | 8/1978 | Tucker et al. |
| 4,168,468 | A | | 9/1979 | Mabuchi et al. |
| 4,197,672 | A | | 4/1980 | Mabuchi et al. |
| 4,209,942 | A | | 7/1980 | Lohr |
| 4,210,218 | A | | 7/1980 | Oswald et al. |
| 4,226,292 | A | | 10/1980 | Monte et al. |
| 4,252,203 | A | | 2/1981 | Oswald et al. |
| 4,275,394 | A | | 6/1981 | Mabuchi et al. |
| 4,283,879 | A | | 8/1981 | Tsui |
| 4,300,308 | A | | 11/1981 | Ikeda |
| 4,306,630 | A | | 12/1981 | Monte et al. |
| 4,363,187 | A | | 12/1982 | Shinohara |
| 4,385,466 | A | | 5/1983 | ReVelle |
| 4,467,557 | A | | 8/1984 | Kuna et al. |
| 4,471,567 | A | | 9/1984 | Martin |
| 4,488,375 | A | | 12/1984 | Cheng |
| 4,490,124 | A | | 12/1984 | Ogawa |
| 4,505,346 | A | | 3/1985 | Mueller |
| 4,508,516 | A | | 4/1985 | D'Andrade et al. |
| 4,511,343 | A | | 4/1985 | Goldfarb et al. |
| 4,562,893 | A | | 1/1986 | Cunard |
| 4,572,311 | A | | 2/1986 | Oswald et al. |
| 4,636,178 | A | | 1/1987 | Oda |
| 4,655,724 | A | | 4/1987 | Law |
| 4,664,212 | A | | 5/1987 | Nagatsuka et al. |
| 4,674,585 | A | | 6/1987 | Barlow et al. |
| 4,680,021 | A | | 7/1987 | Maxim |
| 4,696,655 | A | | 9/1987 | D'Andrade et al. |
| 4,702,331 | A | | 10/1987 | Hagihara et al. |
| 4,717,367 | A | | 1/1988 | Stubenfoll et al. |
| 4,729,444 | A | | 3/1988 | Tubman |
| 4,730,684 | A | | 3/1988 | Pedersen |
| 4,773,889 | A | | 9/1988 | Rosenwinkel et al. |
| 4,813,906 | A | | 3/1989 | Matsuyama et al. |
| 4,825,969 | A | | 5/1989 | King et al. |
| 4,832,651 | A | | 5/1989 | Buck |
| 4,846,758 | A | | 7/1989 | Chou |
| 4,892,503 | A | | 1/1990 | Kumazawa |
| 4,894,042 | A | | 1/1990 | Kamikawa |
| 4,897,070 | A | | 1/1990 | Wagstaff |
| 4,927,401 | A | | 5/1990 | Sonesson |
| 4,930,595 | A | | 6/1990 | Hayward et al. |
| 4,932,491 | A | | 6/1990 | Collins, Jr. |
| 4,969,851 | A | | 11/1990 | Rasmussen |
| 4,977,971 | A | | 12/1990 | Crane, III et al. |
| 4,993,912 | A | | 2/1991 | King et al. |
| 5,019,009 | A | | 5/1991 | Chao-Chin et al. |
| 5,090,934 | A | | 2/1992 | Quercetti |
| 5,135,427 | A | | 8/1992 | Suto et al. |
| 5,173,073 | A | | 12/1992 | Franzone |
| 5,174,405 | A | | 12/1992 | Carra et al. |
| 5,228,880 | A | | 7/1993 | Meyer et al. |
| 5,273,480 | A | | 12/1993 | Suto |
| 5,427,557 | A | | 6/1995 | Lunden, Sr. |
| 5,429,543 | A | | 7/1995 | Tilbor et al. |
| 5,609,510 | A | | 3/1997 | Stubenfoll et al. |
| 5,643,041 | A | | 7/1997 | Mukaida |
| 5,727,985 | A | | 3/1998 | George et al. |
| 5,752,871 | A | | 5/1998 | Tsuzuki |
| 5,762,533 | A | | 6/1998 | Tilbor et al. |
| 5,803,790 | A | | 9/1998 | Tilbor et al. |
| 5,882,241 | A | | 3/1999 | Mullaney et al. |
| 5,919,075 | A | | 7/1999 | George et al. |
| 5,921,843 | A | | 7/1999 | Skrivan et al. |
| 6,095,890 | A | | 8/2000 | George et al. |

FOREIGN PATENT DOCUMENTS

| | | |
|---|---|---|
| JP | 56-1695 | 9/1981 |
| JP | 57-70387 | 3/1982 |
| JP | 59-167584 | 11/1984 |
| JP | 60-43391 | 3/1985 |
| JP | 60-60875 | 4/1985 |
| JP | 60-83693 | 6/1985 |
| JP | 60-109698 | 7/1985 |
| JP | 60-176871 | 9/1985 |
| JP | 61-139288 | 8/1986 |
| JP | 61-154999 | 9/1986 |
| JP | 5-24544 | 2/1993 |
| JP | 5-108144 | 4/1993 |

OTHER PUBLICATIONS

Amai, Wendy A., et al; Robotic All –Terrain Lunar Exploration Rover (Ratler) FY93 Program Status Report, Report No. SAND94–1706, Sandia National Laboratories, Albuquerque, NM, Aug. 1994, 65 pp.

McGovern, Douglas E., et al.; 2 page Abstract of: *A demonstration of retro–traverse using a semi–autonomous land vehicle;* Tactical Weapons Guidance and Control Information Conference on Space and Military Applications of Automation and Robotics; p. 66 (Jun. 1, 1988).

Byrne, R.H.; 2 page Abstract of: *Military robotics technologies at Sandia National Laboratories;* NASA Technical Reports Doc. ID 19910023544 N (91N32858); (Jan. 1, 1991).

Klarer, Paul R.; 2 page Abstract of: *Robotic lunar rover technologies and SEI supporting technologies at Sandia National Laboratories;* Lunar and Planetary Inst., Joint Workshop on New Technologies for Lunar Resource Assessment, p. 35 (Jan. 1, 1992).

Tamiya News, Summer Extra, vol. 267, covers and p. 23, (1992), Tamiya Plastic Model Co., Shizuoka–City, Japan.

Byrne, Raymond H., et al; *Military Robotic Technologies,* Proceedings of the ANS (American Nuclear Society) Fifth Topical Meeting on Robotics and Remote System, pp. 5 and 45–52 (Apr. 1993).

Klarer, P.; *Space Robotics Programs at Sandia National Laboratories,* SSI Conference, May, 1993; pp. 342–347).

Klarer, "Recent Developments in the Robotic All Terrain Lunar Exploration, Rover (RATLER) Program"; Proceedings of the ASCE Specialty Conference, Albuquerque, NM Feb. 6–Mar. 3, 1994 entitled *Robotics For Challenging Environments,* pp. 202–209; American Society of Civil Engineers, NY, NY.

Klarer, "Lunar Exploration Rover Program Developments", NASA Scientific and Technical Report, Doc. ID 19940018996N (94N23469), cover + pages (Jan. 1993).

* cited by examiner

TOY VEHICLE WITH PIVOTALLY MOUNTED SIDE WHEELS

CROSS-REFERENCE TO RELATED APPLICATIONS

This application is a continuation in part of International Application No. PCT/US99/18042 filed Aug. 6, 1999.

BACKGROUND OF THE INVENTION

Radio controlled toy vehicles are well known and have grown to constitute a significant specialty toy market.

Toy manufacturers attempt to duplicate well known vehicles, as well as the latest in automotive developments, including specialty entertainment vehicles. In addition, manufacturers constantly seek new ways and features to add innovative action to such toys to make such vehicles more versatile and/or entertaining.

U.S. Pat. No. 5,429,543, for example, discloses a remote controlled toy vehicle with six wheels, three wheels on each side. The vehicle is balanced such that the vehicle is normally supported by the center pair of wheels and the rear pair of wheels. The vehicle is dynamically balanced such that when the wheels of the center pair are driven in opposite directions, the vehicle pitches forward and the vehicle is supported only by the central pair of wheels. The vehicle spins rapidly on the central pair of wheels about a central vertical axis.

U.S. Pat. No. 5,762,533, for example, discloses a remote controlled toy vehicle with wheels that are adjustably eccentrically mounted on the chassis relative to the axis of rotation of each wheel. This adjustable eccentric mounting permits various permutations of wheel locations relative to the chassis, providing different handling characteristics of the vehicle for each wheel location.

U.S. Pat. No. 5,727,985, for example, discloses a remote controlled toy vehicle having a chassis with two "front" and two "rear" wheels with balloon tires. The tires are resilient and can be elastically compressed against an obstacle. The wheels are mounted on the chassis such that the tires define an outer perimeter of the vehicle. The location of the chassis is wholly within the perimeter; no portion of the vehicle extends beyond the outer perimeter. The resiliency of the tires allows the vehicle to perform a variety of tumbling and deflecting maneuvers. One wheel on each side of the vehicle disclosed in this patent is powered by its own electric motor. Certain commercial versions have both wheels on each side of the vehicle driven by the two motors through separate drive trains in the chassis on each side of the vehicle.

BRIEF SUMMARY OF THE INVENTION

In one embodiment, the present invention is a toy vehicle comprising: chassis having a front end, a rear end and first and second lateral sides; a first pair of wheels located on the first lateral side, the wheels of the first pair being the frontmost and rearmost wheels on the first lateral side; a second pair of wheels located on the second lateral side the wheels of the second pair being the frontmost and rearmost wheels on the second lateral side of the chassis; at least one prime mover on the chassis drivingly coupled with at least one of the first pair of wheels; characterized by a first beam pivotally mounted to the first lateral side of the chassis approximately halfway between the front end and the rear end, the first pair of wheels being rotatably mounted on the first beam, distal from the chassis.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
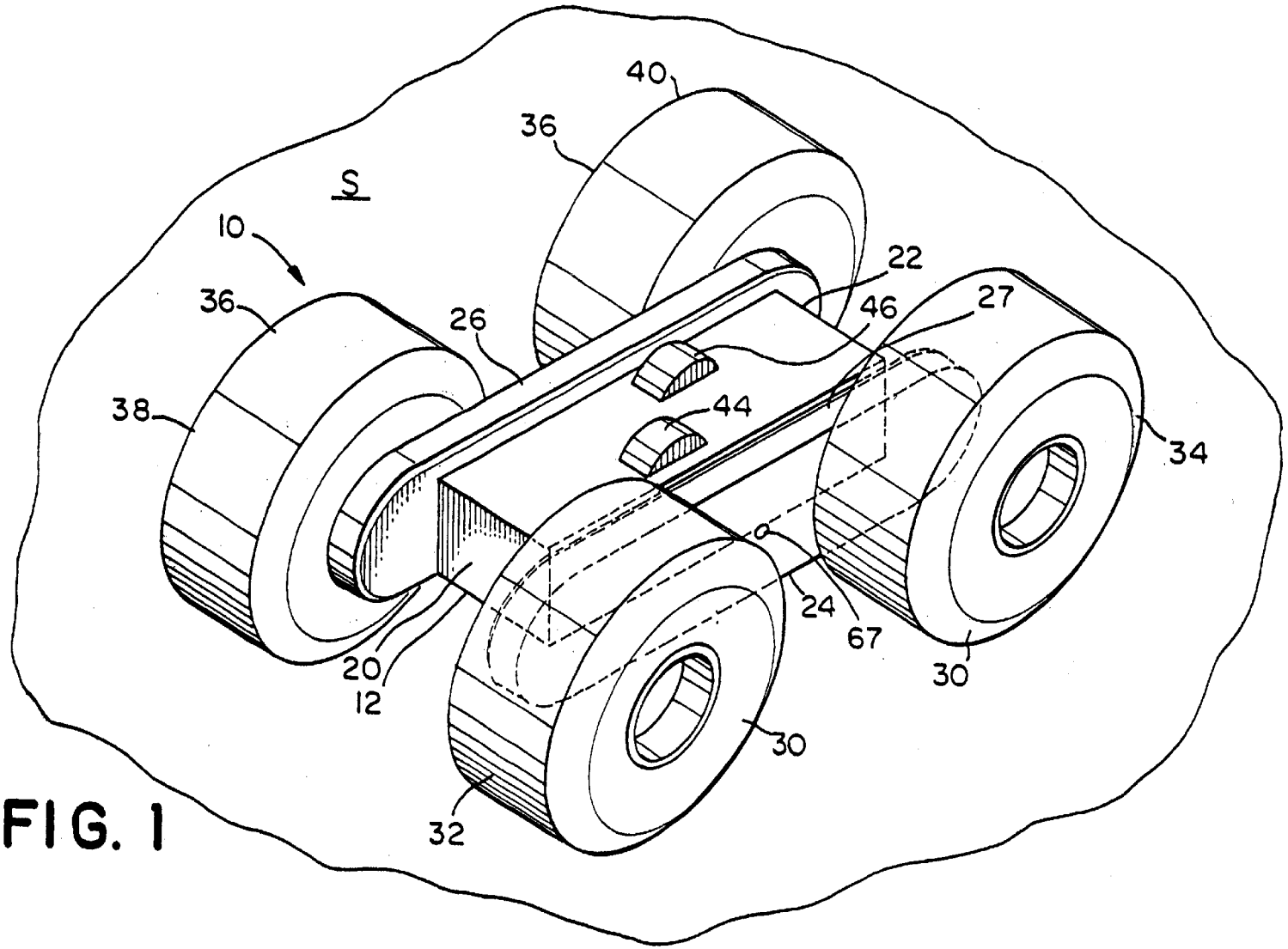
FIG. 1 is a perspective view of a first preferred embodiment of the toy vehicle with the body removed.

Certain terminology is used in the following description for convenience only and is not limiting. The words "lower" and "upper" designate directions in the drawings to which reference is made. The words "inwardly" and "outwardly" refer to directions toward and away from, respectively, the geometric center of the vehicle and designated parts thereof. The word "a" is defined to mean "at least one". The words "left" and "right", as used herein, correspond to the sides of the vehicle as viewed in FIG. 4. The terminology includes the words above specifically mentioned, derivatives thereof and words of similar import. In the drawings, like numerals are used to indicate like elements throughout.

A first preferred embodiment of a preferred toy vehicle of the present invention capable of performing on a playing surface "S" is indicated generally at 10 in FIGS. 1 through 4. The vehicle 10 preferably comprises a substantially integral and rigid chassis, indicated generally at 12, supporting an aerodynamically shaped body, indicated generally at 14 in FIGS. 2 and 3. The body 14 may be provided with vehicular detailing, which may be three dimensional (functional or non-functional) or merely surface ornamentation provided to simulate such functional elements. For example, the body 14 may be provided with such detail as a bank of header pipes, an external fluid cooler (oil, transmission, or both), undercarriage details, etc.

Figure 2:
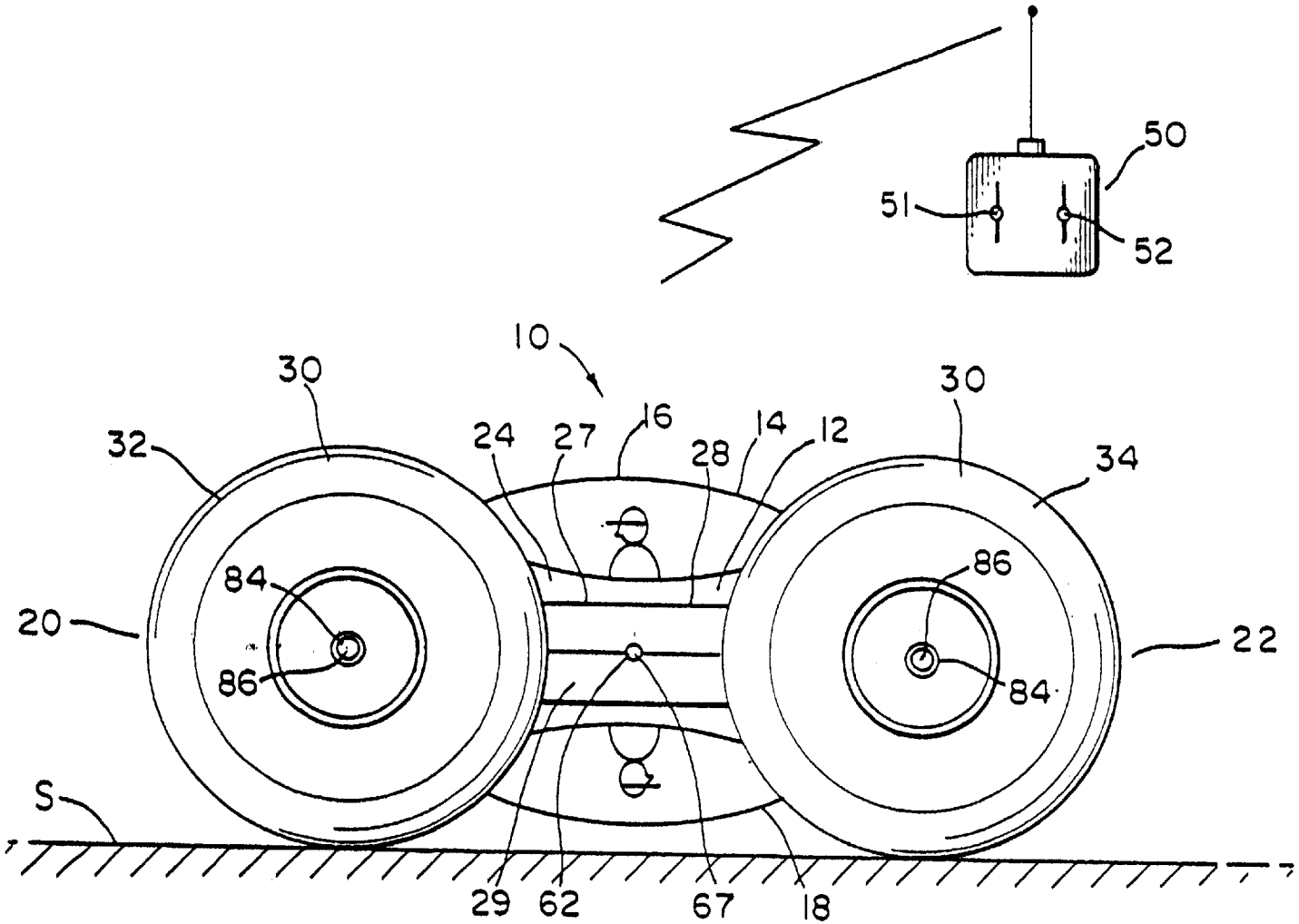
FIG. 2 is a left side elevational view of the toy vehicle.
Figure 3:
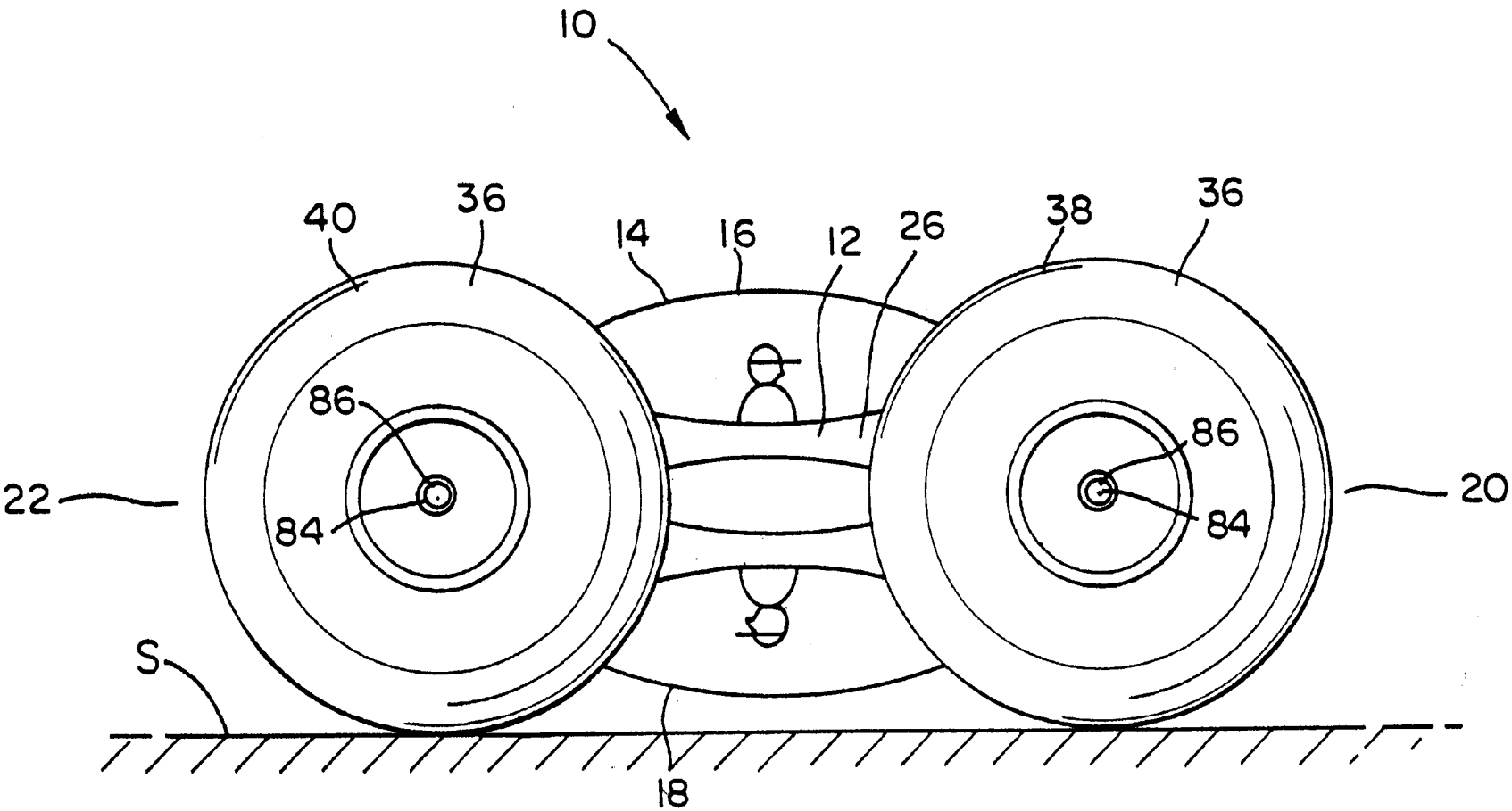
FIG. 3 is a right side elevational view of the toy vehicle.

Referring now to FIGS. 2 and 3, the body 14 can be one body type and color on a top side 16 and an alternate body type and color on a bottom side 18. Additionally, the body 14 can be in the form of other aerodynamic styles or conventional passenger car, truck, and other vehicle styles. The vehicle 10 may also be equipped with lights (not shown), which are illuminated when the vehicle is being operated. The chassis 12 and the body 14 are constructed of, for example, plastic or any other suitable material, such as wood or metal. The chassis 12 may be integrally formed with an outer skin or body in a monocoque construction or may be separately formed and support a non-load bearing outer skin or body.

The chassis 12 has a front end 20, a rear end 22, a first lateral side 24 (FIG. 2), and a second lateral side 26 (FIG. 3). The two different body types on the top side 16 and the bottom side 18 preferably face opposing directions, one body type facing the front end 20 and the second body type facing the rear end 22.

Referring now to FIGS. 1 and 2, a first beam 27 is pivotally mounted to the first lateral side 24 of the chassis 12. A first pair of wheels 30 including a first front wheel 32 and a first rear wheel 34 is rotatably mounted on the first lateral side 24 of the chassis 12 and the vehicle 10. Each of the wheels 30 is rotatably mounted on the first beam 27 at opposing ends of the beam, on a side distal from the chassis 12. Referring to FIG. 3, a second pair of wheels 36 including a second front wheel 38 and a second rear wheel 40 is rotatably mounted on an opposite side (second lateral side) of the chassis 12 and the vehicle 10 from the first beam 27 and the first pair of wheels 30. The four wheels 32, 34, 38, 40 are also the frontmost and rearmost pairs of wheels on the two lateral sides 24, 26 of the vehicle 10.

Figure 4:
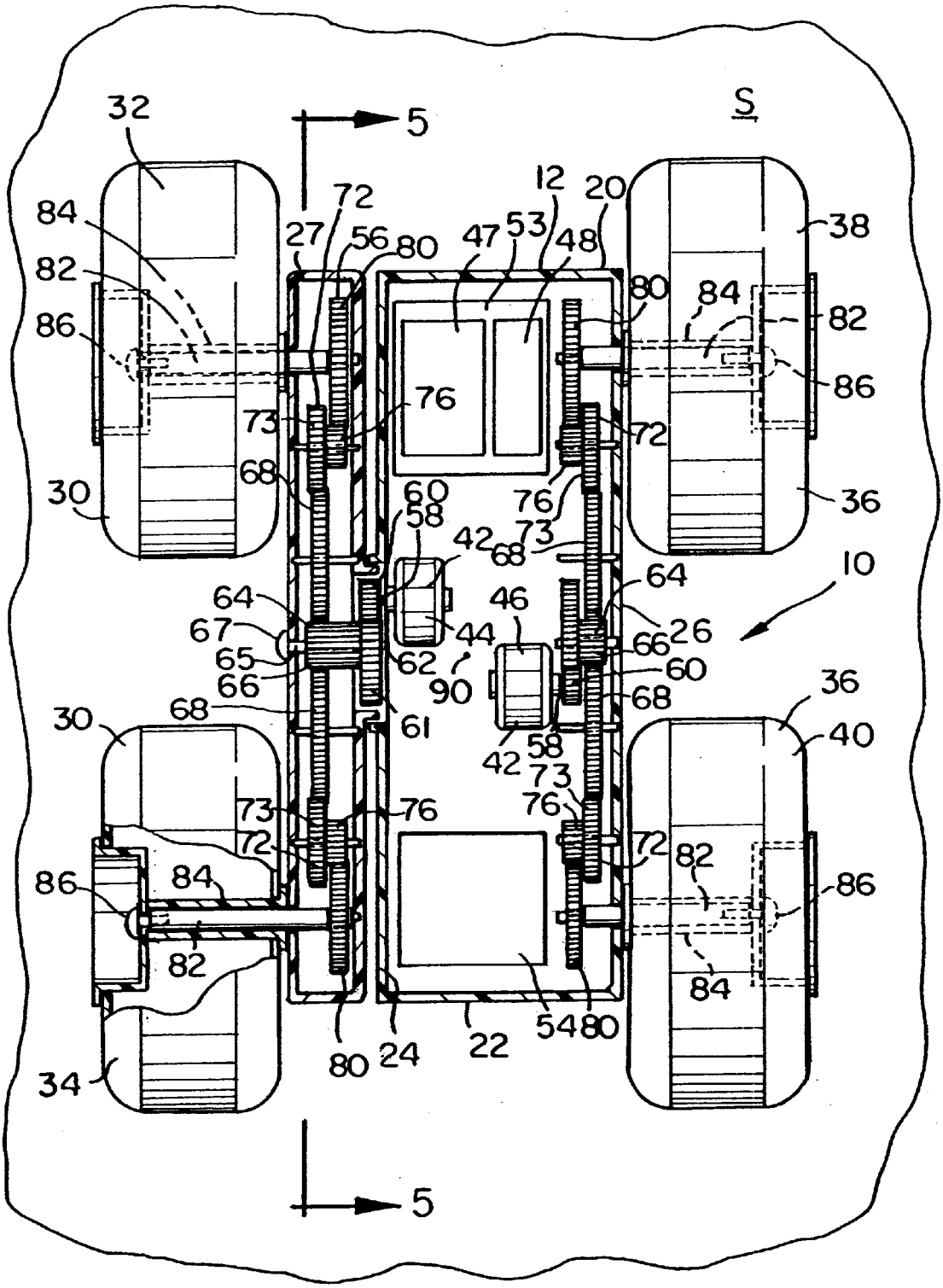
FIG. 4 is a plan view, partially broken away, of the toy vehicle as shown in FIG. 1.

Referring now to FIG. 4, the first beam 27 is pivotally mounted to the first lateral side 24 of the chassis 12. Preferably first beam 27 is mounted on an axle 62, located approximately halfway between the front end 20 and the rear end 22 such that it can rotate more than 360 degrees around the axle 62 on the chassis 12.

Referring still to FIG. 4, motor means 42 are located on the chassis 12 and are drivingly coupled with at least one wheel of the first pair 30 and, preferably, with each of the first pair of wheels 30 and the second pair of wheels 36 for selectively driving each of the first pair of wheels 30 and the second pair of wheels 36 selectively and simultaneously at least in one linear direction (forward or reverse), and at least simultaneously in opposite linear directions. The motor means 42 preferably includes a first prime mover, preferably a first electric motor 44, drivingly coupled with the first pair of wheels 30 and a second prime mover, preferably a second electric motor 46, independently operable from the first motor 44 and drivingly coupled with the second pair of wheels 36. Preferably, the motors 44, 46 are reversible, although those skilled in the art will realize that non-reversible motors can be used, but will decrease the functional capability of the vehicle 10. The wheels 32, 34, 38, and 40 may be made of any suitable material, and are preferably formed from rigid plastic hubs with hollow resiliently flexible tires which are open to atmosphere so that they might resiliently collapse on impact.

The first motor 44 and the second motor 46 are respectively electrically connected to a controller 47 and may be independently controlled. Preferably the controller 47 is connected to a radio receiver 48, such as a high frequency receiver circuit, for receiving and processing control signals from a source remote to the vehicle 10, such as a remote control device 50, shown in FIG. 2. The remote control device 50 may have a pair of toggle switches 51, 52, or other similar type switches, to generate signals separately controlling operation of each of the first motor 44 and the second motor 46.

Referring back to FIG. 4, the controller 47 and the radio receiver 48 are preferably mounted on a PC board 53 located in the vehicle 10. The controller 47, radio receiver 48, remote control device 50, and electric motors 44 and 46 are entirely conventional and are based on well known, existing radio controlled vehicle designs, such as disclosed in U.S. Pat. No. 5,135,427, which is incorporated by reference herein in its entirety. Such control systems can be obtained directly from manufacturers, such as Taiyo Kogyo of Tokyo, Japan and others or U.S. distributors selling radio control vehicle products and/or parts. Since the vehicle 10 of the present invention uses the same or similar controller circuitry as described in U.S. Pat. No. 5,135,427, these elements will not be further discussed herein.

A power source 54 for supplying the vehicle's power, is contained within the chassis 12 for powering both of the electric motors 44, 46 and the circuitry of the controller 47 and radio receiver 48. The power source 54 may comprise a removable set of alkaline or other batteries (not shown) or a conventional rechargeable power pack (e.g. 7.2 volts). However, those skilled in the art will realize that other types of power sources can be used.

Figure 5:
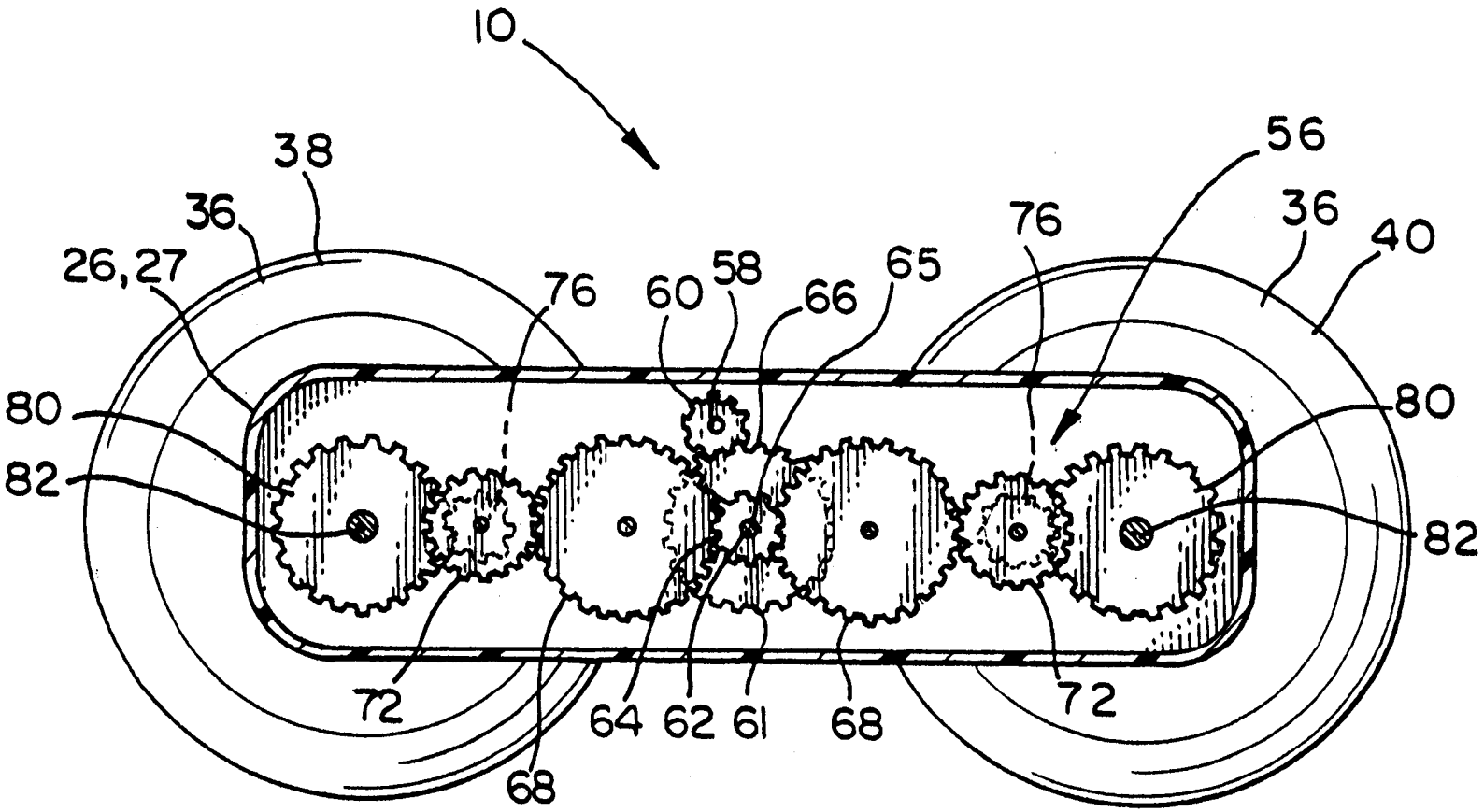
FIG. 5 is a sectional view of the toy vehicle along line 5—5 in FIG. 4.

Each motor 44, 46 is drivingly connected to its respective pair of wheels 30, 36 preferably via a plurality of gears rotatably mounted on the first beam 27 and a like plurality of gears rotatably mounted on the chassis 12. FIG. 5 shows a sectional view of the plurality of gears driving the first pair of wheels 30, which are arranged in a drive train 56, as viewed from the first lateral side 24. A like plurality of gears drives the second pair of wheels 36 and have an identical appearance when viewed from the second lateral side 26. Although the following description only refers to the drive train 56 between the first motor 44, a motor drive pinion 64 and the first front wheel 32, the description also pertains to the drive train between the drive pinion 64 and the first rear wheel 34 as well as the drive train between the second motor 46 and the second front and rear wheels 38 and 40.

Referring now to FIGS. 4 and 5, an output shaft 58 of the first motor 44 is fixedly attached to a motor pinion 60 located on the first lateral side 24. The output of the motor pinion 60 drives a main gear 61 which is rotatably mounted to a pivot in the form of the axle 62, which is unpowered and non-rotating. The axle 62 is mounted to the chassis 12 and is located approximately half way between the front end 20 and the rear end 22. The drive pinion 64 is drivingly connected to the first motor 44 through the main gear 61 and is fixedly mounted to, and co-axial with, the main gear 61, forming a double gear 66. The axle 62 on the first lateral side 24 is internally threaded on an end 65 distal from the chassis 12. The first beam 27 is pivotally mounted on the axle 62. Preferably, a cap screw 67 is threaded onto the end 65 of the axle 62 to pivotally fasten the first beam 27 about the axle 62. However, those skilled in the art will recognize that other fasteners, such as a pressed bushing, can be used.

The drive pinion 64 drives a first idler gear 68 which in turn drives a second idler gear 72. An idler pinion 76 is fixedly mounted to, and co-axial with, the second idler gear 72, forming a double idler gear 73 (FIG. 4). The idler pinion 76 drives a wheel gear 80. The idler gears 68, 72, the idler pinion 76, and the wheel gear 80 are all rotatably mounted to the first beam 27. Preferably, all gear components are made of a plastic or other lightweight polymer, although those skilled in the art will realize that the gear components can be made from other materials as well.

Preferably, the wheel gear 80 is fixedly attached to, and co-axial with, a splined shaft 82. The first front wheel 32 contains a wheel hub 84 concentrically located therein. The wheel hub 84 is keyed such that the splined shaft 82 is slidably locatable (i.e. can be slid) through the wheel hub 84 of the first front wheel 32 to provide a non-rotating connection between the splined shaft 82 and the wheel hub 84. An end of the splined shaft 82 located distal from the chassis 12 is internally threaded. After the splined shaft 82 is slid through the wheel hub 84, a cap screw 86, whose threads match the internal threads of the splined shaft 82, is screwed into the splined shaft 82, fixedly fastening the first front wheel 32 to the wheel gear 80. However, those skilled in the art will recognize that other fasteners, such as a pressed bushing, can be used. The wheel gear 80 thus drivingly couples the wheel 32 to the drive pinion 64.

The drive train between the drive pinion 64 and the wheel hub 84 of first rear wheel 34 is a mirror image of the drive train 56 between the drive pinion 64 and the wheel hub 84 of first front wheel 32. The second front wheel 38 and the second rear wheel 40 are identically driven except that, on the second lateral side, idler gears 68, 72, idler pinion 76, and wheel gear 80 are all rotatably mounted to the chassis 12 instead of the separate, pivotally mounted beam 27.

Preferably, the wheels 32, 34, 38, and 40 are driven by gears. However, those skilled in the art will understand that belts or other forms of power transmission can be used to transfer the power from the motors 42, 44 to the wheels 32, 34 and 38, 40, respectively, without departing from the scope of the invention. Additionally, it is preferred that the gears are spur gears, but those skilled in the art will understand that other types of gears, including, but not limited to, bevel gears as well as drive shafts may also be used.

Further, although two idler gears 68, 72 are disclosed between the drive gear 61 and the wheel gear 80 in each drive train 56, any number of idler gears may be used between the drive pinion 64 and the wheel gear 80, so long as the front wheels 32, 38 rotate in the same direction as their respective rear wheels 34, 40, and as long as all wheels 32, 34, 38, and 40 rotate with the same linear speed when rotating in the same direction when equivalent power is applied from each respective electric motor 44, 46.

Since the preferred electric motors 44 and 46 are reversible and independently controllable, the first pair of wheels 30 and the second pair of wheels 36 can be selectively driven simultaneously in the same direction or in opposite directions, or one pair of wheels 30 and 36 can be driven while the other pair of wheel 30 and 36 is stationary. In this manner, the vehicle 10 can be made to spin or turn in either direction without the need for any of the wheels 34, 34, 38, and 40 to be steerably mounted to pivot with respect to the chassis 12 about a vertical axis perpendicular to a plane through the centers of all four wheels and to the plane of FIG. 4.

In operation, both the vehicle 10 and the remote control unit 50 are provided with power switches (not depicted) which are turned "ON". If a user desires the vehicle 10 to proceed forward, the user manipulates the toggle switches 51, 52 on the remote control unit 50 to direct the first motor 44 and the second motor 46, respectively, to rotate in the same direction relative to the vehicle 10. The motors 44, 46 transmit their power through the drive trains 56 located on each of the first lateral side 24 and the second lateral side 26 to the wheels 32, 34, 38, and 40 to rotate the first pair of wheels 30 in one direction, and the second pair of wheels 36 in the same direction. If the user desires the vehicle 10 to proceed backward, the user operates the toggle switches 51, 52 in an opposite direction, directing the first motor 44 and the second motor 46, respectively, to rotate in the same direction relative to the vehicle 10, but in the opposite direction they rotated to provide vehicle forward motion.

Since both the first motor 44 and the second motor 46 are independently operable, the vehicle 10 can turn by manipulating the motor directions. To turn the vehicle 10, one motor 44, 46 can be stopped, and the other motor 44, 46 can be operated to pivot the vehicle 10 about a vertical axis in a longitudinal vertical plane of the wheel pair 30, 36 that is not turning (i.e., is stopped). In the event that the user desires the vehicle 10 to turn faster than the turning operation described above, the operator can direct one motor 44, 46 forward, and the other motor 44, 46 in reverse, rotating the first wheel pair 30 in one direction and rotating the second wheel pair 36 in the opposite direction, causing the vehicle 10 to swiftly rotate about the vertical axis 90. As an alternate turning method, the user can operate one motor 44, 46 at full power, and operate the other motor 44, 46 in the same direction at partial power, causing the vehicle 10 to rotate in the direction of pair of wheels 30, 36 whose respective motor 44, 46 is operating at partial power. This turning capability permits the wheels 32, 34, 38, and 40 to rotate without the need for any of the wheels 32, 34, 38, 40 to be steerably mounted to pivot with respect to the chassis 12 about the vertical axis 90.

Figure 7:
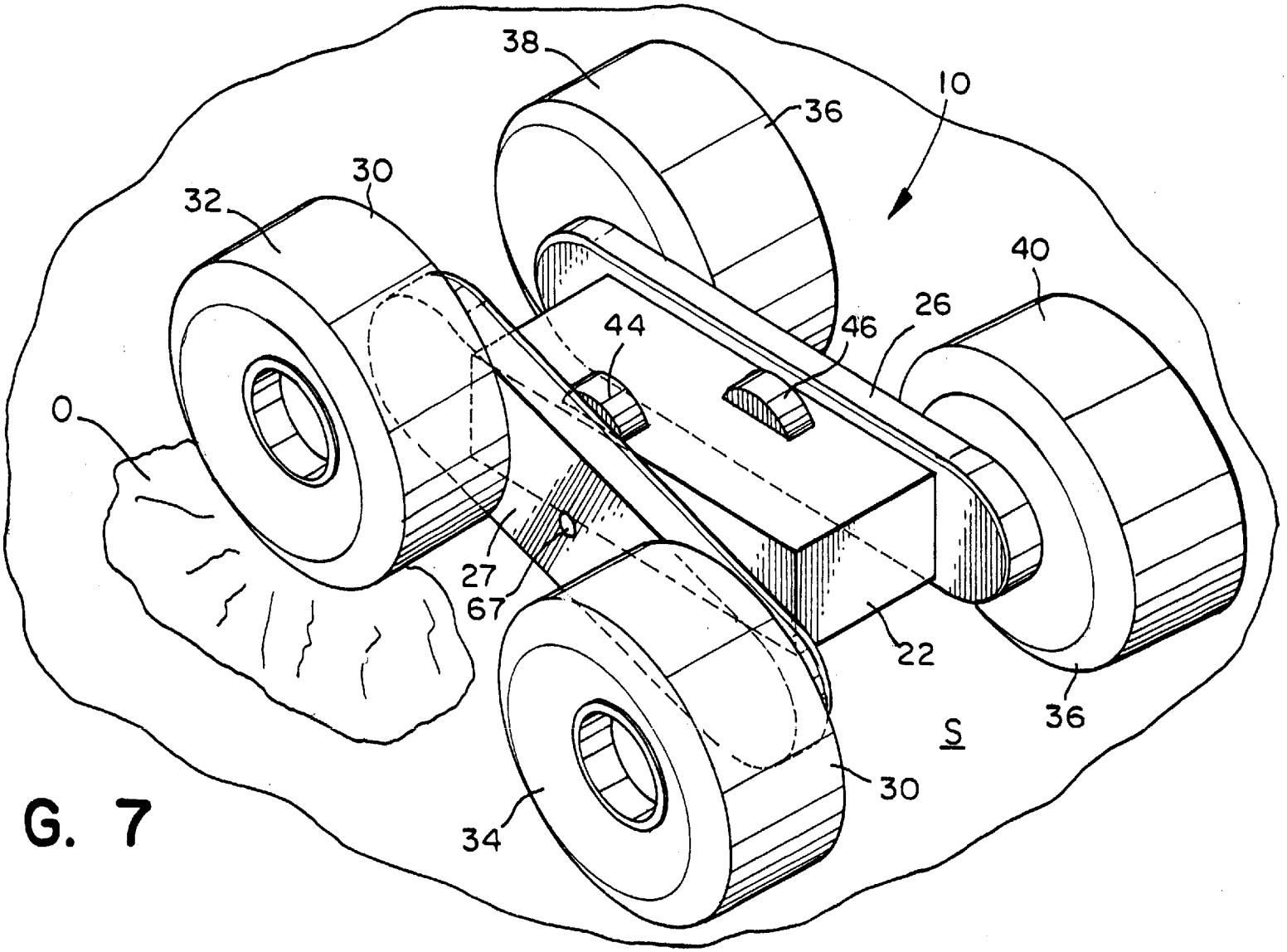
FIG. 7 is a perspective view of the toy vehicle of FIGS. 1–5, with the body removed, climbing over an obstacle.

As shown in FIG. 7, in the event that the first front wheel 32 encounters an obstacle O which is small relative to the first front wheel 32, the first front wheel 32 rolls over the obstacle O. The first beam 27 pivots about the axle 62 upward at the first front wheel 32, keeping the first rear wheel 34 and the second pair of wheels 36 on the surface S as the first front wheel 32 traverses the obstacle O. The pivoting capability of the first beam 27 provides for an infinitely variable range of suspension travel, with all wheels 32, 34, 38, and 40 maintaining contact while adapting to the terrain.

In the event that the first front wheel 32 encounters an obstacle O which is large relative to the first front wheel 32, which precludes continued forward motion of the first front wheel 32, the drag on the wheel 32 causes the beam 27 to be rotated by the motor 44 about the axle 62 to raise the first front wheel 32, driving the first front wheel 32 up the object O and bringing the first rear wheel 34 underneath the first front wheel 32. When the first rear wheel 34 is sufficiently below the first front wheel 32, the first beam 27 will flip over, exposing a bottom side 29 of the first beam 27.

If the second front wheel 38, which is fixed with respect to the chassis 12, encounters an obstacle O which is large relative to the size of the second front wheel 38, the second front wheel 38 will continue to rotate, causing the chassis 12 to climb up the obstacle O. If the second rear wheel 40 of the chassis 12 moves sufficiently under the second front wheel 38, the chassis 12 will flip backwards, exposing the bottom side 18.

If both the first front wheel 32 and the second front wheel 38 encounter an obstacle O, such as a wall, which is large relative to the size of the first front wheel 32 and the second front wheel 38, both the first front wheel 32 and the second front wheel 38 will continue to rotate, causing the vehicle 10, including the chassis 12 and the first beam 27, to climb up the obstacle O. When the rear wheels 34, 40 are sufficiently below the front wheels 32, 38, both the chassis 12 and the first beam 27 will flip backwards, exposing the chassis bottom side 18 and the beam bottom side 29. The vehicle 10 will repeat the process of climbing and flipping until the obstacle O is removed from the path of the vehicle 10 or the vehicle 10 is turned away from the obstacle O.

Figure 6:
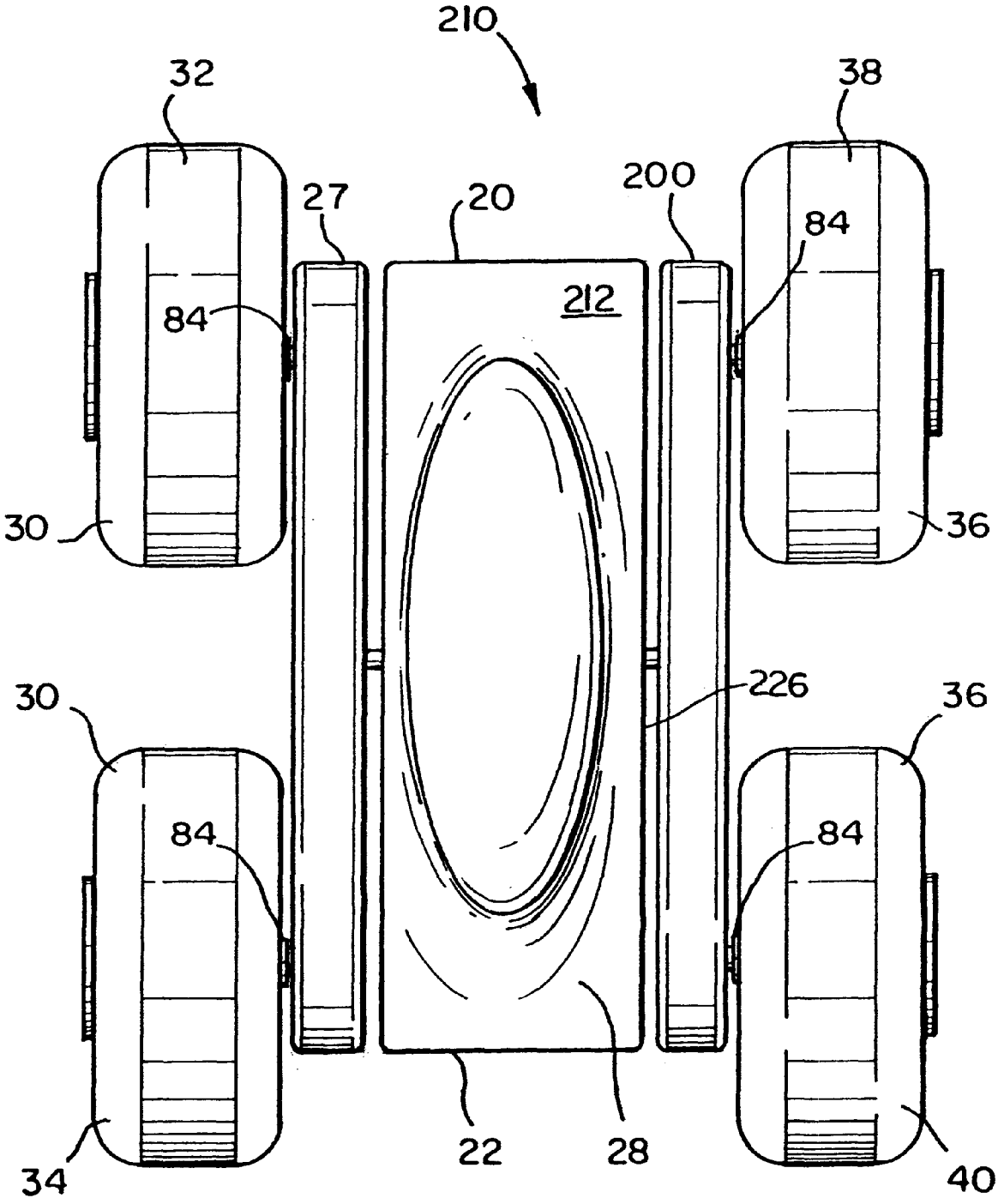
FIG. 6 is a plan view of a second embodiment toy vehicle.

In a second embodiment vehicle 210, as shown in FIG. 6, a second beam 200 can be pivotally mounted to a second lateral side 226 of a chassis 212. The second pair of wheels 36 and its respective drive train can be moved from the chassis 212 to the second beam 200 in a configuration similar, if not identical, to the configuration in the drive train 56 which is shown in FIG. 5, with the second pair of wheels 36 being rotatably mounted to the second beam 200, distal from the chassis 212. The second beam 200 can also be pivotable on the chassis 212 on the second lateral side 226 approximately halfway between the front end 20 and the rear end 22 of the chassis 212.

Operation of the second embodiment is similar to the operation of the first embodiment with the exception that, if only the second pair of wheels 36 encounters an obstacle, only the second beam 200, and not the entire chassis 212, pivots.

Figure 8:
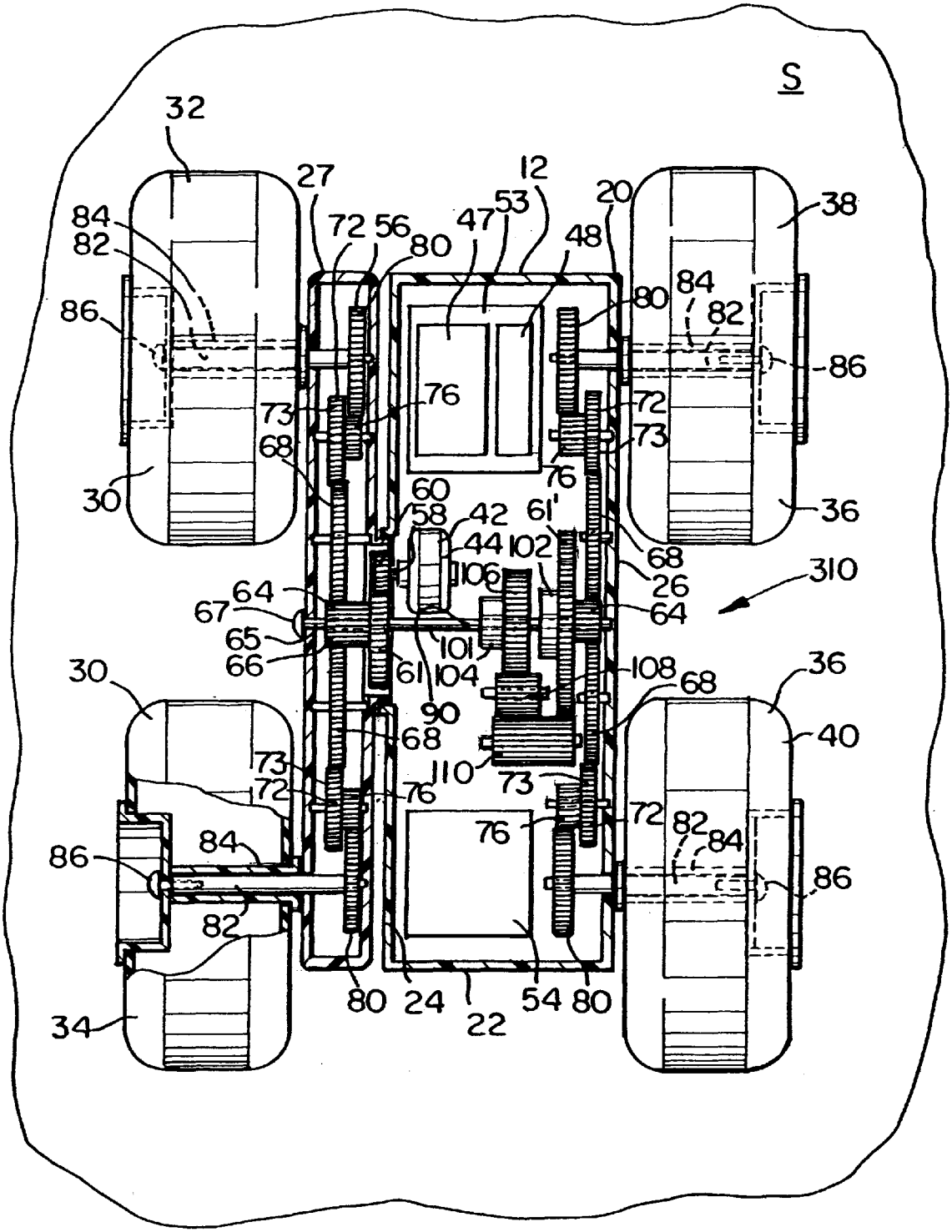
FIG. 8 is a plan view of a third embodiment toy vehicle.

In a third embodiment, shown in FIG. 8, a single motor 44 is used to drive the vehicle 310. The motor 44 is drivingly connected with the drive train 56 on the first lateral side 24 of the vehicle 310. A first end of a through-shaft 101, fixedly attached to main gear 61, extends through the width of the vehicle 310, where a second end of through-shaft 101 is rotatably attached to a main gear 61'. A counter-clockwise one-way clutch 102 is rotatably mounted about the through-shaft 101 and is fixedly attached to the main gear 61'. A clockwise one-way clutch 104 is rotatably mounted about the through shaft 101 and is fixedly attached to a clutch spur gear 106. Main gear 61', counter-clockwise one-way clutch 102, clockwise one-way clutch 104, and clutch spur gear 106 are all co-axial about the through-shaft 101. A first clutch idler gear 108 is rotatably connected to the clutch spur gear 106. A second clutch spur gear 110 is rotatably connected to the first clutch idler gear 108 and to the main gear 61'.

In operation, the motor 44 drives the gear train 56 on the first lateral side 24 as previously described herein. When the user desires the vehicle 310 to proceed forward, the motor 44 drives the main gear 61 in a clockwise direction when viewed from the first lateral side 24. Clockwise rotation of the main gear 61 when viewed from the first lateral side 24 rotates the first pair of wheels 30 in a counter-clockwise direction. The counter-clockwise clutch 102 engages the through-shaft 101 with the main gear 61', driving the main gear 61' in a clockwise direction when viewed from the first lateral side 24. The clockwise clutch 104 does not engage with the shaft 101 and merely spins about the through-shaft 101. By driving main gear 61' in a clockwise direction when viewed from the first lateral side 24, the second pair of wheels 36 rotate in a counter-clockwise direction and the vehicle 310 proceeds in a forward linear direction.

When the user desires the vehicle 310 to turn, the motor 44 drives the main gear 61 in a counter-clockwise direction when viewed from the first lateral side 24. Counter-clockwise rotation of the main gear 61 rotates the first pair of wheels 30 in a clockwise direction. The clockwise clutch 104 engages the through-shaft 101 with the clutch spur gear 106, rotating the clutch spur gear 106 in a counter-clockwise direction. The counter-clockwise clutch 102 does not engage with shaft 101 and merely spins about through-shaft 101. Clutch spur gear 106 drives first clutch idler gear 108, which in turn, drives second clutch idler gear 110 in a counter-clockwise direction. The second clutch idler gear 110 thus drives main gear 61' in a clockwise direction when viewed from the first lateral side 24. By driving main gear 61' in a clockwise direction when viewed from the first lateral side 24, the second pair of wheels 36 rotate in a counter-clockwise (forward) direction and the vehicle 10' turns approximately about the central vertical axis through chassis 12. Idler gears 108 and 110 provide a speed reduction between clutch spur gear 106 and main gear 61'. This speed reduction provides for increased torque for the second pair of wheels 36 compared to the first pair of wheels 30.

Figure 9:
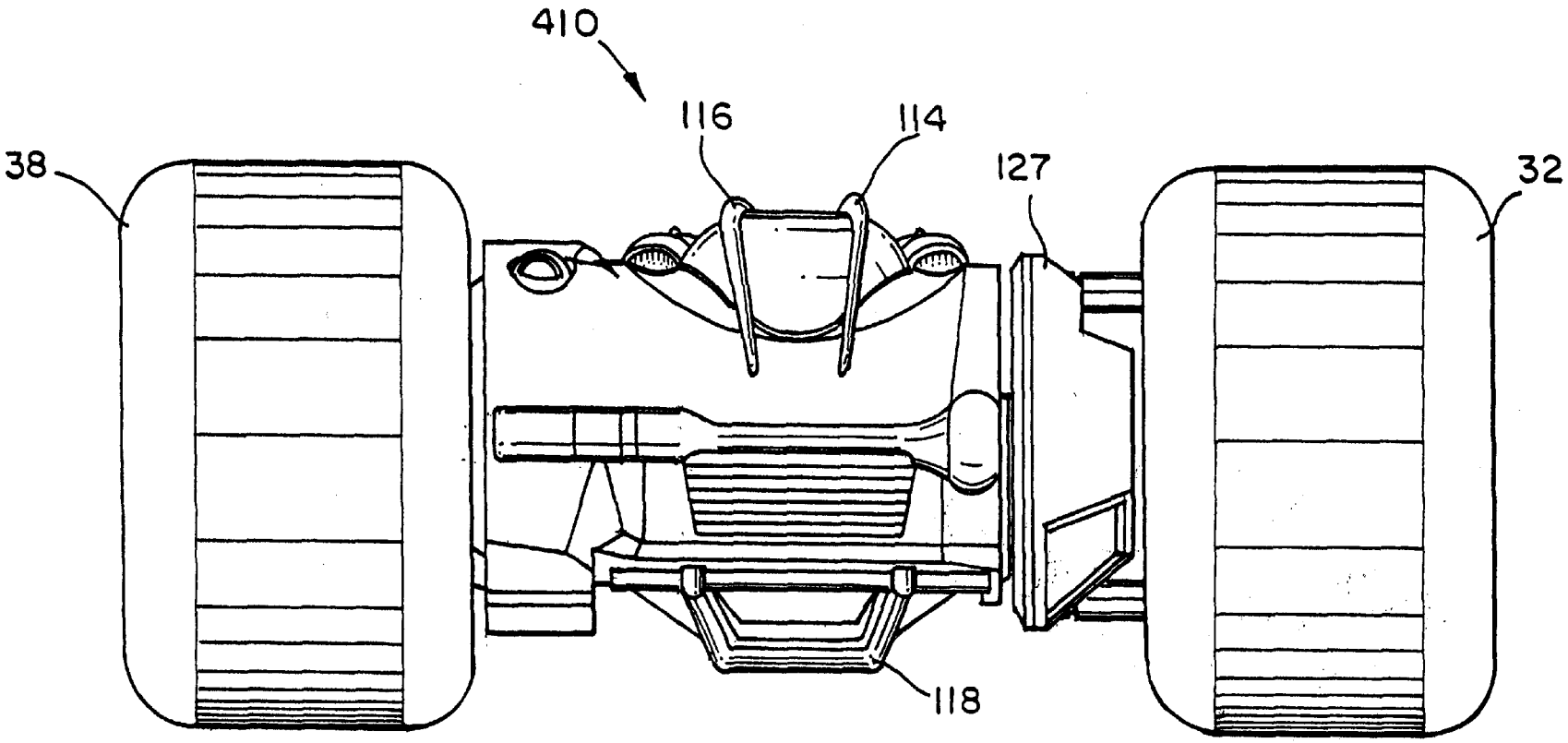
FIG. 9 is a front elevational view of a fourth embodiment toy vehicle.
Figure 10:
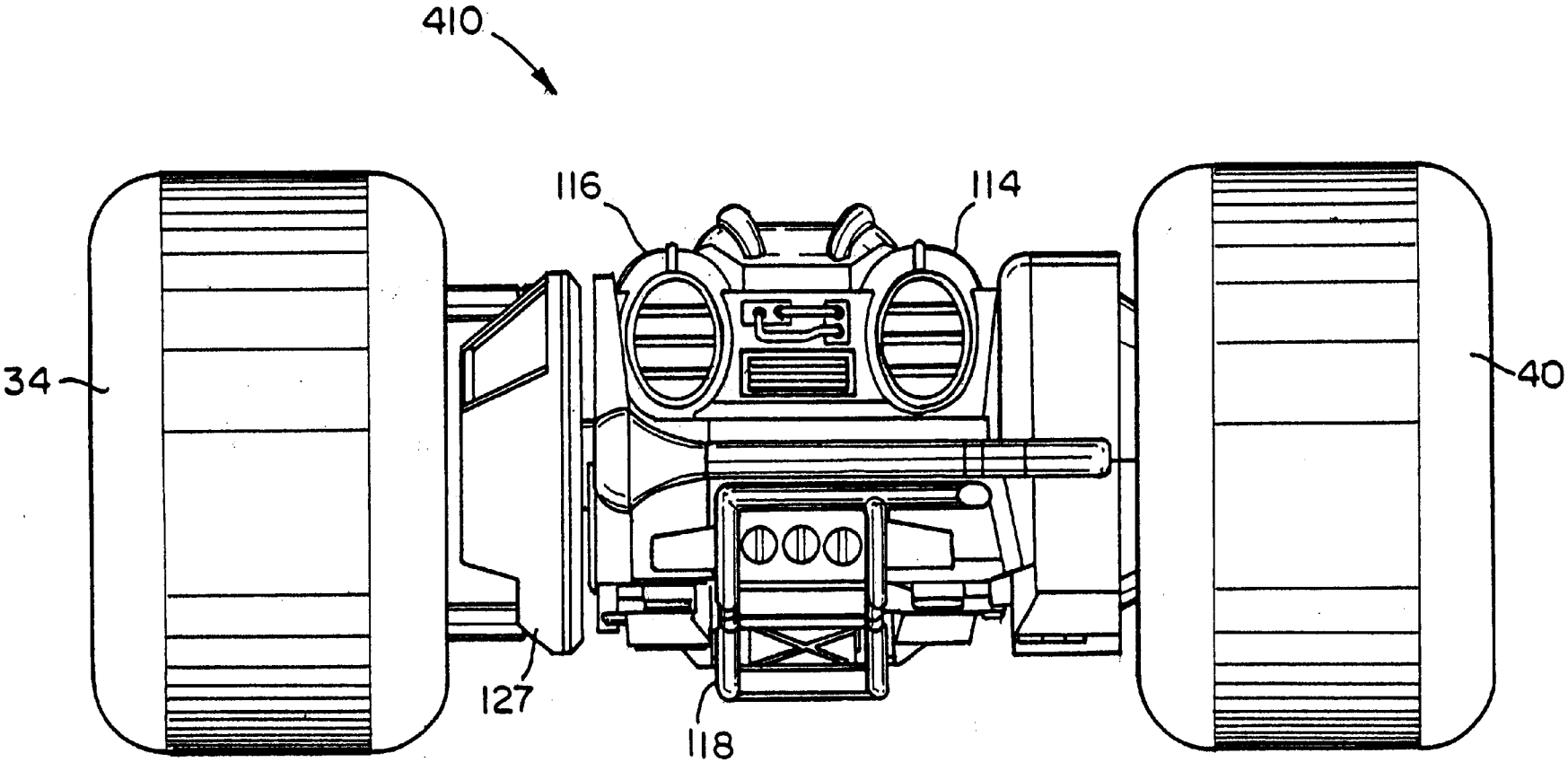
FIG. 10 is a rear elevational view of the fourth embodiment toy vehicle.

A fourth embodiment of the invention is identified as vehicle 410, as shown in FIGS. 9–12. Referring now to FIGS. 9 and 10, the body 114 can be one body type and color on a top side 116 and an alternate body type and color on a bottom side 118. Preferably, the body type on the top side 116 displays a top of a vehicle with cockpit and the body type on the bottom side 118 displays a bottom of a vehicle with crash bars, simulated transmission and oil pan and the like, making the toy vehicle 410 more life-like in appearance.

Figure 11:
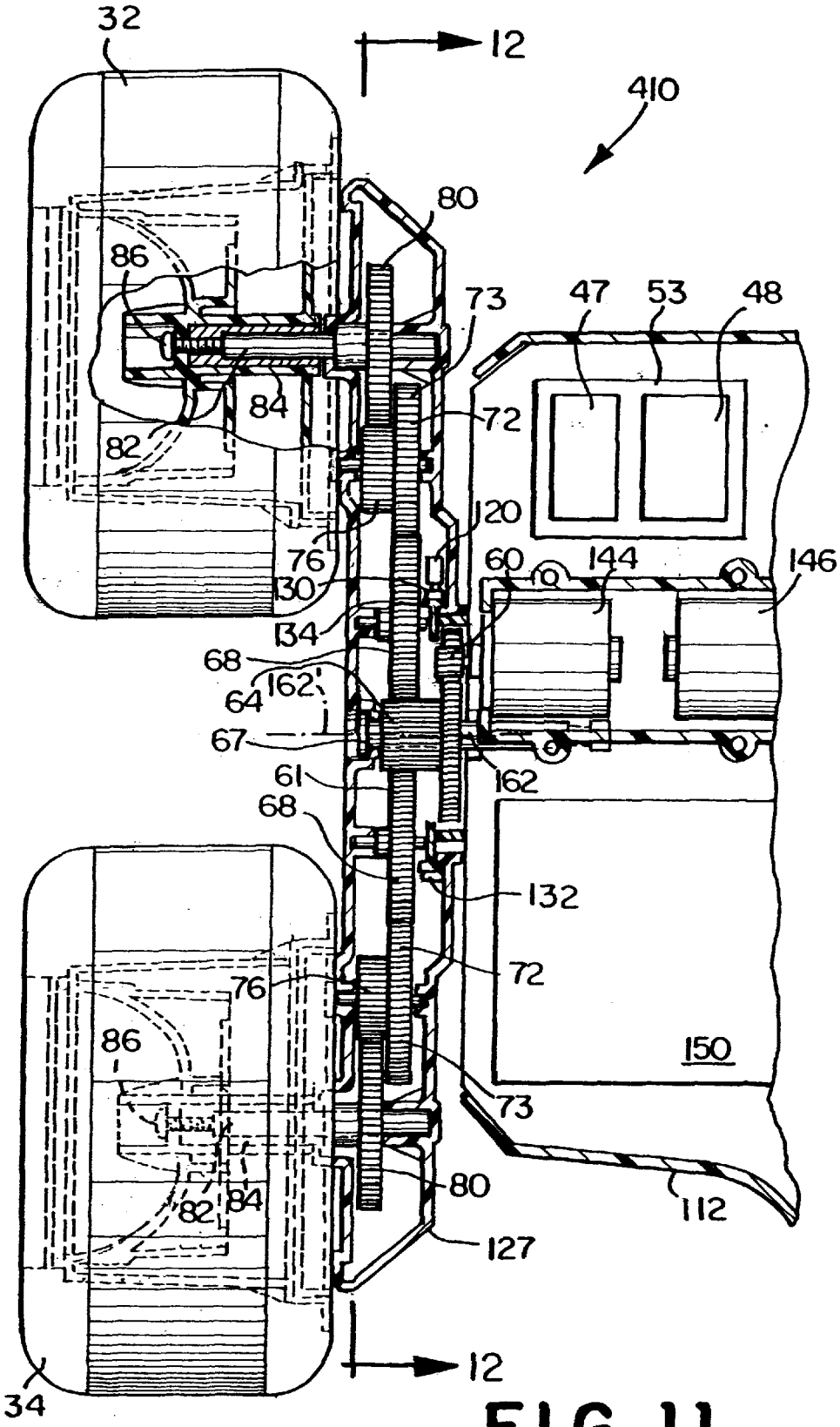
FIG. 11 is a partial top plan view, partially in section, of the drive mechanism of the fourth embodiment toy vehicle.
Figure 12:
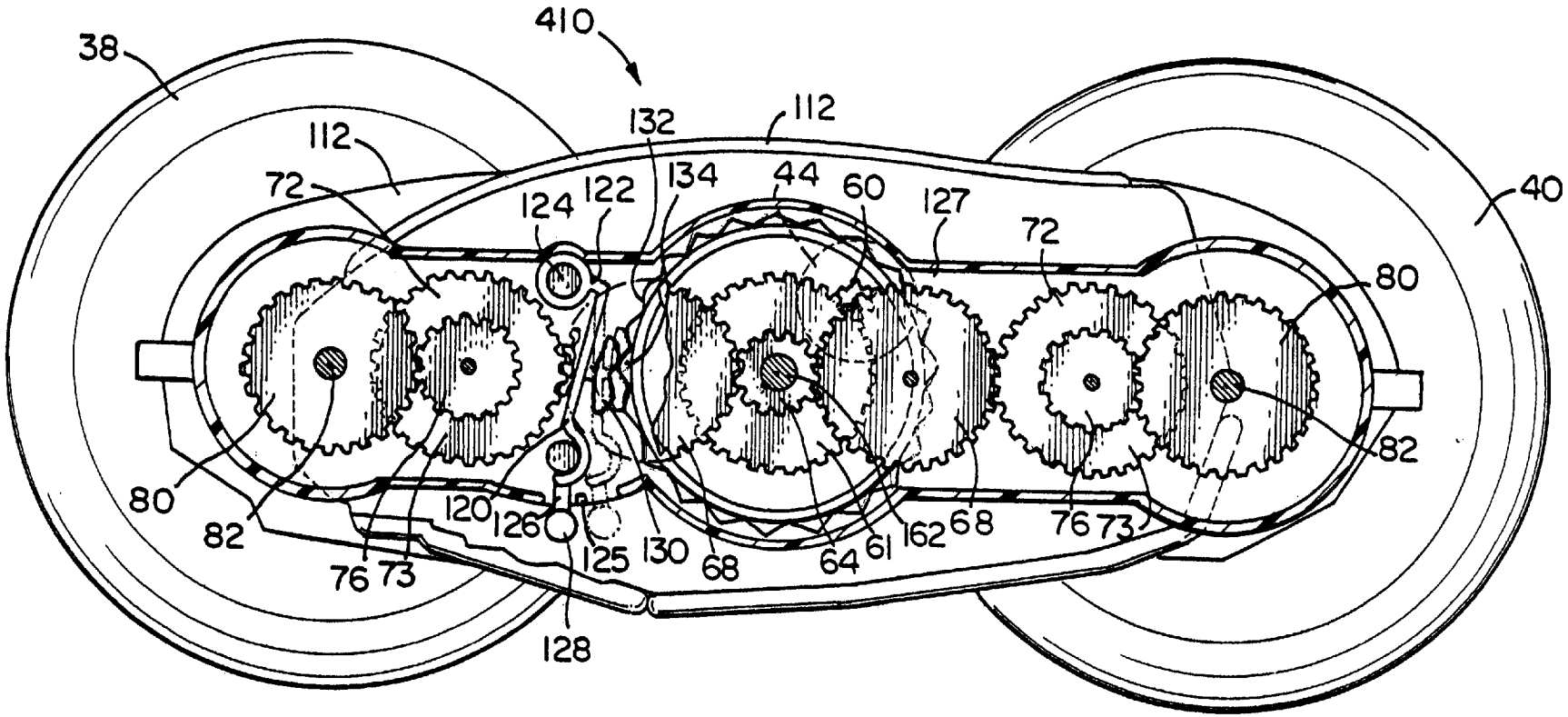
FIG. 12 is a sectional view of the toy vehicle taken along line 12—12 of FIG. 11.

Referring to FIGS. 11 and 12, the vehicle 410 includes a locking lever 120 which releasably locks a first beam 127 to the chassis 112. As shown in FIG. 11, the locking lever 120, is located on the first beam 127. As shown in FIG. 12, the locking lever 120 is shiftable between two positions, a first, disengaged position as shown in solid lines and a second, engaged position as shown in phantom lines. A separating plate 125, which is attached at one end to the beam 127, separates the first and second positions. The locking lever 120 includes a first end 122 which is pivotally attached to the beam 127 at a connection 124 and a second end 126 that extends beyond the first beam 127 and preferably includes a knob 128 that the user operates to toggle the locking lever 120 around the separating plate 125 between the first and second positions.

The locking lever 120 includes an angled stop plate 130 which is preferably located approximately half-way between the first and second ends 122, 126. The stop plate 130 is engageable with detents 132 along an outer perimeter of a ring gear 134. Preferably, the detents 132 extend about every 15° around the outer perimeter of the ring gear 134, although those skilled in the art will realize that the detents 132 can extend at different intervals and that the detents 132 need not extend entirely around the ring gear 134. The ring gear 134 is located within the first beam 127 but is fixedly connected to the chassis 112. The ring gear 134 surrounds, but does not engage, a central axle 162.

When the locking lever 120 is in the first position (in solid in FIG. 12), the beam 127 is free to pivot about the axle 162. When the locking lever 120 is in the second position (in phantom in FIG. 12), the stop plate 130 engages detents 132 and the beam 127 is fixed to the chassis 112. However, the stop plate 130 can slip at least one detent 132 or more while the lever 120 is in the second position to allow the beam 127 to rotate about the axle 162 when a sufficient amount of rotational force is externally applied to either the beam 127 or the chassis 112 (i.e., when the vehicle 410 flips or lands after a jump or being dropped). The feature of allowing the stop plate 130 to slip at least one detent 132 provides for more exciting operational capabilities and also reduces the risk of damaging the vehicle 410 while performing stunts.

It should be noted that the beam 127 can be fixed to the chassis 112 in any position about the ring gear 134 equivalent to the locations of the detents 132. For example, the beam 127 can be rotated ninety degrees from the position shown in FIG. 11, with one of the front and rear wheels located above the other of the front and rear wheels. With the beam 127 in this position, the vehicle 410 is riding on three wheels. Since all of the wheels 32, 34, 38, and 40 are preferably rotating at the same linear speed, and the axles 82 of each of the wheels 32, 34, 38, 40 are generally parallel to each other, the vehicle 410 travels in a generally straight direction.

Operation of the vehicle 410 is similar to the operation of the vehicle 10, with the added feature of being able to rotate and lock the beam 127 using the locking lever 120 as described above.

Additionally, as shown in FIG. 11, in the vehicle 410, the motors 144, 146 are located on the same side of a central transverse axis 162' coincident with the axle 162, as compared to the motors 44, 46 which are on opposite sides of the central axis coincident with the axle 62 as shown in the vehicle 10 in FIG. 4. The motors 144, 146 being on the same side of the central axis more evenly distributes the weight of the vehicle 410 about the geometric center of the vehicle 410, with the weight of the motors 144, 146 being offset by the weight of a power supply, such as batteries 150 which are located on the other side of the central axis from the motors 144, 146. The more even distribution of weight about the geometric center of the vehicle 410 allows the vehicle 410 to perform more uniformed and balanced stunts.

One of ordinary skill will appreciate that, although the motor means 42 preferably is electric, other means for moving the vehicle 10, including hydraulic, pneumatic, spring wound, flywheel or other inertial and electromagnetic prime movers could be used. One of ordinary skill will further appreciate that wired or tether control of the vehicle from a remotely located handset is also possible. Power or fuel also can be supplied from a source remote from the vehicle through a wire, pipe, optic fiber, etc.

Although the presently preferred embodiments of the toy vehicle 10, 210, 310, 410 are remotely controlled via radio signals, it should be understood that other types of remotely controlled (both hard wire and other types of wireless control) toy vehicles as well as toy vehicles which are not controlled are also within the scope of the invention. Thus, it is recognized that less expensive toy vehicles having some of the novel features of the invention can be made, notably a pivoting beam on at least one lateral side of the chassis, preferably allowing an infinite range of suspension travel, and are within the scope of the invention.

It will further be appreciated that, for instance, a wind-up or spring actuated motor or gasoline engine could be substituted for each electric motors of the present invention. It will further be appreciated that a vehicle of the present invention could also be provided with a single reversible prime mover with a drive train that permits a remotely controlled gear or other member to be engaged (or disengaged if previously engaged), when desired, to reverse the direction of the motor drive output to one of the first and second pairs of wheels, or disconnect that output, so that the vehicle can normally move forward or backward but will spin or turn in either direction when the remotely controlled gear or other member is moved. Also, twin motors can be provided to drive the same main gear for greater torque and the vehicle maneuvered as indicated above for a single prime mover. Similarly, a pair of prime movers can be provided but controlled together. One control switch on a remote control unit can be used to drive both motors in the same forward or backward linear driving direction and another independent control switch can be used to control turning by reversing or disconnecting the power being supplied to one of the two motors. Still other arrangements are possible.

Furthermore, while a series of engaged spur gears are shown being used to transmit rotary motion, other types of members including drive shafts, belt or chain and pulley or the like and/or other types of gears can be used to transmit rotary motion from the prime mover to the beams(s) and wheels.

It will be understood by those of ordinary skill in the art that although the invention is described herein in terms of preferred, four-wheeled embodiments, the present invention could also comprise a vehicle having three wheels, or more than four wheels. Thus, the present invention is described in terms of a four-wheeled vehicle for convenience only, and is not to be limited to a four-wheeled vehicle.

Further, while it is preferred that all four wheels be of the same outside diameter, those skilled in the art will recognize that wheels of different outside diameters may be used at different locations on the vehicle 10. For example, a first wheel in each of the first and second pairs of wheels 30, 36 can be a different size than a second wheel in each of the first and second pairs of wheels 30, 36.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. A toy vehicle comprising:

a chassis having a front end, a rear end and first and second lateral sides;

a first pair of wheels located on the first lateral side, the wheels of the first pair being the frontmost and rearmost wheels on the first lateral side;

a second pair of wheels located on the second lateral side, the wheels of the second pair being the frontmost and rearmost wheels on the second lateral side of the chassis;

at least one prime mover on the chassis drivingly coupled with at least one of the first pair of wheels wherein the prime mover is a first electric motor drivingly coupled with the first pair of wheels and further comprising a second electric motor independently operable from the first motor and drivingly coupled with the second pair of wheels; and a first beam pivot mounted to pivot on the first lateral side of the chassis approximately halfway between the front end and the rear end, the first pair of wheels being rotatably mounted on the first beam, distal from the chassis.

2. The toy vehicle according to claim 1 further comprising a second beam mounted to pivot on the second side of the chassis approximately halfway between the front end and the rear end, the second pair of wheels being rotatably mounted on the second beam.

3. The toy vehicle according to claim 2 wherein all road contacting wheels of the vehicle on the first lateral side of the chassis are mounted on the first beam.

4. The toy vehicle according to claim 3 wherein all road contacting wheels of the vehicle on the second lateral side of the chassis are mounted on the second beam.

5. The toy vehicle according to claim 2 wherein all road contacting wheels of the vehicle on the second lateral side of the chassis are mounted on the second beam.

6. The toy vehicle according to claim 1 wherein the first electric motor is drivingly coupled with the first pair of wheels via a plurality of gears rotatably mounted on the first beam and the second electric motor is drivingly coupled with the second pair of wheels via an identical plurality of gears rotatably mounted on the chassis.

7. The toy vehicle according to claim 1 further comprising:

a first drive pinion is drivingly connected with the first motor;

a first front wheel gear fixedly mounted to a first front wheel of the first pair of wheels and drivingly coupling the first front wheel with the first drive pinion;

a first rear wheel gear fixedly mounted to a first rear wheel of the first pair and drivingly coupling the first rear wheel with the first drive pinion;

a second drive pinion drivingly connected with the second motor;

a second front wheel gear fixedly mounted to a second front wheel of the second pair and drivingly coupling the second front wheel with the second drive pinion; and a second rear wheel gear fixedly mounted to a second rear wheel of the second pair and drivingly coupling the second rear wheel with the second drive pinion.

8. The toy vehicle according to claim 7 wherein at least one idler gear drivingly couples the first drive pinion with the first front wheel gear, an identical number of idler gears drivingly couple the first drive pinion with the first rear wheel gear, an identical number of idler gears drivingly couple the second drive pinion with the second front wheel gear, and an identical number of idler gears drivingly couple the second drive pinion with the second rear wheel gear.

9. The toy vehicle according to claim 7 wherein the first drive pinion rotates a common axis with the first beam.

10. The toy vehicle according to claim 1 wherein the first beam is mounted to rotate completely about an axis transverse to the chassis.

11. The toy vehicle according to claim 10 further comprising a drive gear drivingly coupled between the first prime mover and at least one wheel of the first pair of wheels and mounted on the first lateral side of the chassis to also rotate on the transverse axis coaxially with the first beam, the first beam and the drive gear rotating with respect to one another and the chassis on the transverse axis.

12. The toy vehicle according to claim 1 wherein a second beam is mounted to pivot on the chassis, distal from the first beam, the second pair of wheels being rotatably mounted to the second beam.

13. The toy vehicle according to claim 1 wherein none of the wheels is steerably mounted to pivot with respect to the chassis about a vertical axis.

14. The toy vehicle according to claim 1 wherein the first beam can releasably lock to the chassis.

15. A toy vehicle comprising;

a chassis having a front end, a rear end and first and second lateral sides;

a first pair of wheels located on the first lateral side, the wheels of the first pair being the frontmost and rearmost wheels on the first lateral side;

a second pair of wheels located on the second lateral side, the wheels of the second pair being the frontmost and rearmost wheels on the second lateral side of the chassis;

at least one prime mover on the chassis drivingly coupled with at least one of the first pair of wheels;

a one-way automatically engaging clutch drivingly coupling at least one of the second pair of wheels with the prime mover in one direction; and a first beam pivot mounted to pivot on the first lateral side of the chassis approximately halfway between the front end and the rear end, the first pair of wheels being rotatably mounted on the first beam, distal from the chassis.

16. The toy vehicle according to claim 15 further comprising a second one-way clutch drivingly coupling at least one of the second pair of wheels with the prime mover in a direction opposite to the one direction of the first one-way clutch.

17. The toy vehicle according to claim 15 wherein each of the first beam and second beam is rotatable more than 360 degrees on the chassis.

18. The toy vehicle according to claim 15 wherein none of the wheels of the first pair and second pair is steerably mounted to pivot with respect to the chassis about a vertical axis.

19. The toy vehicle according to claim 15 wherein at least the first beam can be releasably locked to the chassis.

* * * * *